US005332324A

United States Patent [19]

Hochstetler

[11] Patent Number: 5,332,324

[45] **Date of Patent: * Jul. 26, 1994**

[54] ERGONOMIC INSTRUMENTS

[76] Inventor: Michael A. Hochstetler, 1123 Miami Trail, Bremen, Ind. 46506

[ * ] Notice: The portion of the term of this patent subsequent to Jul. 20, 2010 has been disclaimed.

[21] Appl. No.: 16,463

[22] Filed: Feb. 11, 1993

Related U.S. Application Data

[63] Continuation of Ser. No. 708,767, May 31, 1991, Pat. No. 5,228,794.

[51] Int. Cl.[5] ..... A46B 5/02

[52] U.S. Cl. ..... 401/6; 401/88; D19/50

[58] Field of Search ..... 401/6, 7, 88, 96; 15/443; D19/50, 42

[56] References Cited

U.S. PATENT DOCUMENTS

| | | | |
|---|---|---|---|
| D. 19,277 | 8/1889 | Todd | 401/6 |
| D. 21,195 | 12/1891 | Mussinan | D19/50 |
| D. 42,553 | 5/1912 | Tolfree | D19/50 X |
| D. 161,310 | 12/1950 | Brown | D19/50 |
| D. 252,815 | 9/1979 | Coffman | D19/50 X |
| 2,263,885 | 11/1941 | McGauley | 401/6 X |
| 4,149,811 | 4/1979 | Coffman | 401/6 |
| 4,217,712 | 8/1980 | Koeln | 401/88 X |
| 4,601,598 | 7/1986 | Schwartz et al. | 401/6 |

FOREIGN PATENT DOCUMENTS

| | | | |
|---|---|---|---|
| 2143780 | 2/1985 | United Kingdom | 401/6 |

*Primary Examiner*—Danton D. DeMille
*Attorney, Agent, or Firm*—Lundy & Associates

[57] ABSTRACT

An ergonomic, hand held instrument comprising an instrument and a shell. The shell has a longitudinal axis and opposite ends and a hollow interior. The instrument is positioned within the shell with its operational end extending from one end of the shell. The shell has a groove therein extending from adjacent the one end at least a partial revolution about said shell to adjacent the other end. The groove has a bottom and an upstanding wall. The groove spirals around the shell. The bottom has a width greater than the size of one's fingers. The spiral may have one or more partial turns or a single continuous turn or partial turn between the opposite ends of the shell. The bottom extends from the wall toward the other end and is tapered from one turn of the wall to an adjacent turn of the wall with the wall facing the other end whereby one can pick up the instrument and very easily grip the instrument correctly with a lighter grip than with conventional instruments and yet press harder during use without the fatigue, cramps or calluses normally related to use of the instrument for long periods of time.

16 Claims, 2 Drawing Sheets

ERGONOMIC INSTRUMENTS

CROSS-REFERENCE TO RELATED APPLICATIONS

This is a continuation of a pending application, Ser. No. 07/708,767, filed May 31, 1991 now U.S. Pat. No. 5,228,794.

BACKGROUND OF THE INVENTION

The present invention relates to an ergonomic instrument, and more particularly to an instrument held like a writing instrument which can be better gripped to reduce fatigue, cramps and the like, which urges the user to hold the instrument correctly and which may even improve one's dexterity with the instrument.

Pens and pencils have long been available. However, from the quill to the conventional wooden pencil to automatic pencils and ballpoint pens, little has been proposed to improve such writing instruments which allow the instrument to be better gripped and reduce fatigue, hand cramps, calluses and the like associated with prolonged periods of handwriting and urges the user to hold the instrument correctly.

Handwriting has been taught in a variety of ways, i.e., the Palmer Method, etc. All of these methods urge a person, whether right-handed or left-handed, to hold a writing instrument in a certain fashion and it has been shown that holding a writing instrument in that fashion both reduces fatigue and improves one's handwriting. Many writing instruments are difficult to grip, especially when one's hands are greasy or perspiring, and older people, children and handicapped people often times have difficulty in gripping conventional writing instruments. Those who write a lot experience writer's cramps, fatigue and calluses.

Surgical instruments, stylus for computer use, such as CAD/CAM drawing, long nose tools, dental instruments, pen lights, medical instruments, handheld portable lasers, and a myriad of other instruments all held like writing instruments have all of these writing instrument problems. All of these problems with such instruments are desirably rectified.

It is therefore highly desirable to provide a new and improved ergonomic instrument.

It is also highly desirable to provide a new and improved instrument which gives support to both the index finger and thumb when held in a natural position.

It is also highly desirable to provide a new and improved instrument in which the instrument does not need to be gripped tightly when pressing hard or hardly pressing.

It is also highly desirable to provide a new and improved instrument which is easy to hold in use by children, older people and handicapped persons.

It is also highly desirable to provide a new and improved instrument which is configured to urge persons to hold the instrument in a correct manner.

It is also highly desirable to provide a new and improved instrument which is adjustable to any hand at any distance at which a person usually holds the instrument.

It is also highly desirable to provide a new and improved instrument which reduces fatigue, prevents cramps and calluses related to use of the instrument.

It is also highly desirable to provide a new and improved instrument which is both distinctive and aesthetically pleasing.

It is finally highly desirable to provide a new and improved instrument having all of the above features which can be used by both right-handed and left-handed persons.

SUMMARY OF THE INVENTION

It is an object of the invention to provide a new and improved ergonomic instrument.

It is also an object of the invention to provide a new and improved instrument which gives support to both the index finger and thumb when held in a natural position.

It is also an object of the invention to provide a new and improved instrument in which the instrument does not need to be gripped tightly when pressing hard or hardly pressing.

It is also an object of the invention to provide a new and improved instrument which is easy to hold in use by children, older people and handicapped persons.

It is also an object of the invention to provide a new and improved instrument which is configured to urge persons to hold the instrument in a correct manner.

It is also an object of the invention to provide a new and improved instrument which is adjustable to any hand at any distance at which a person usually holds the instrument.

It is also an object of the invention to provide a new and improved instrument which reduces fatigue, prevents cramps and calluses related to use of the instrument.

It is also an object of the invention to provide a new and improved instrument which is both distinctive and aesthetically pleasing.

It is finally an object of the invention to provide a new and improved instrument having all of the above features which can be used by both right-handed and left-handed persons.

In the broader aspects, there is provided an ergonomic, hand held instrument comprising an instrument and a shell. The shell has a longitudinal axis and opposite ends and a hollow interior. The instrument is positioned within the shell with its operational end extending from one end of the shell. The shell has a groove therein extending from adjacent the one end at least a partial revolution about said shell to adjacent the other end. The groove has a bottom and an upstanding wall. The groove spirals around the shell. The bottom has a width greater than the size of one's fingers. The spiral may have one or more partial turns or a single continuous turn or partial turn between the opposite ends of the shell. The bottom extends from the wall toward the other end and is tapered from one turn of the wall to an adjacent turn of the wall with the wall facing the other end whereby one can pick up the instrument and very easily grip the instrument correctly with a lighter grip than with conventional instruments and yet press harder during use without the fatigue, cramps or calluses normally related to use of the instrument for long periods of time.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
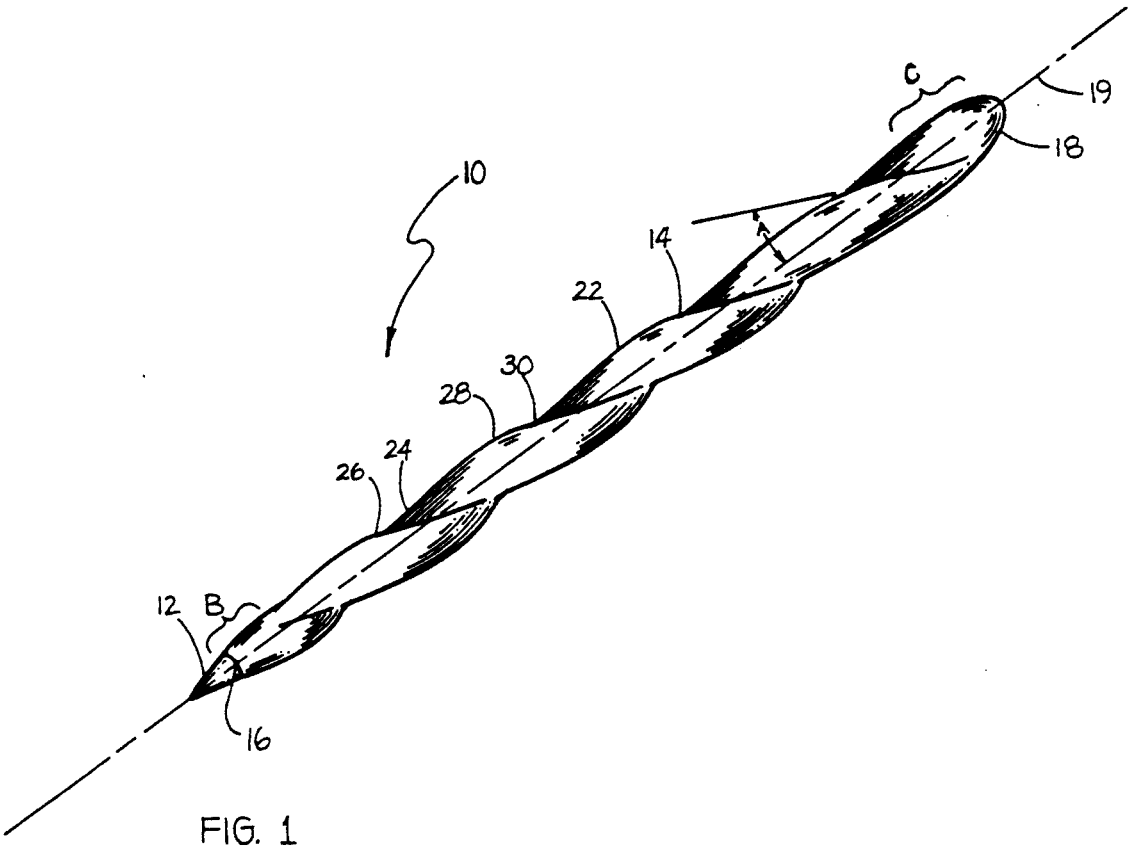
FIG. 1 is a side view of the improved ergonomic instrument of the invention.
Figure 2:
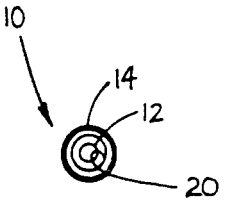
FIG. 2 is an end view thereof.
Figure 3:
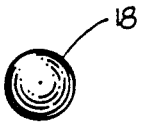
FIG. 3 is a view of the opposite end of the improved ergonomic instrument shown in FIG. 1 from the end opposite that shown in FIG. 2.
Figure 4:
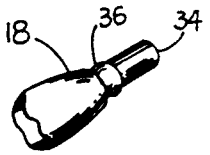
FIG. 4 is a modified opposite end of the ergonomic instrument of the invention shown in partial side view.
Figure 5:
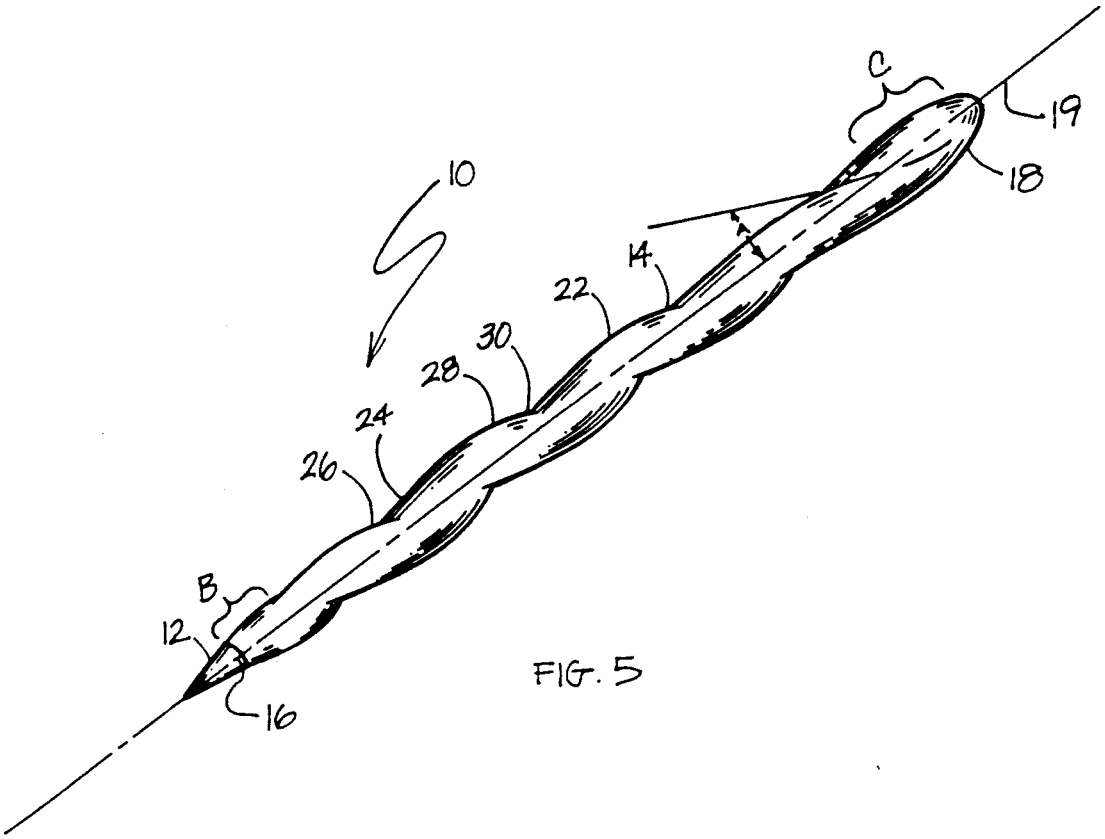
FIG. 5 is a side view like FIG. 1 of the improved ergonomic instrument of the invention in which only partial turns of the groove are on opposite sides of the instrument.
Figure 6:
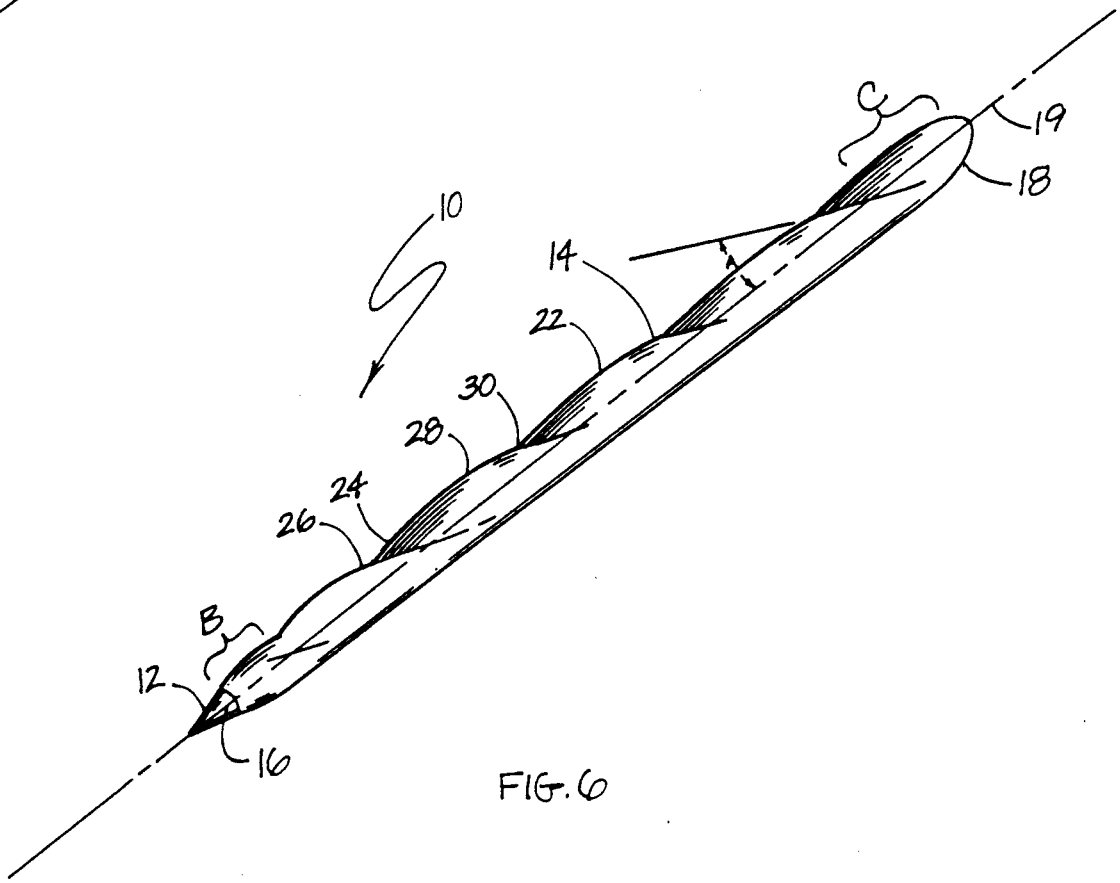
FIG. 6 is a side view like FIG. 1 of the improved ergonomic instrument of the invention in which only partial turns of the groove are on only a single side of the instrument.

The improved ergonomic hand held instrument 10 of the invention includes an instrument 12 and a shell 14 having opposite ends 16, 18. Shell 14 has an axis 19 and a hollow interior 20. The instrument 12 is positioned within the interior 20 and secured to the shell 14 coaxially thereof, as is conventional, with its operational end exposed adjacent shell end 16. The words "operational end" are used herein to indicate that end of the instrument which dictates its use.

The shell 14 has a groove 22 therein extending from adjacent end 16 to adjacent end 18. The groove 22 has a bottom 24 and an upstanding wall 26. The groove 22 spirals around the shell 14. In one specific embodiment, groove 22 spirals around shell 14 in a clockwise manner when viewed from end 18. In another specific embodiment, groove 22 spirals around shell 14 in the opposite direction. Bottom 24 has a width greater than the size of one's fingers. The groove 22 has at least a partial turn between ends 16, 18 of shell 14. Bottom 24 extends from wall 26 toward end 18. Bottom 24 is tapered from one portion of wall 26 to an adjacent portion of wall 26. Wall 26 faces toward end 18. In specific embodiments, shell 14 may be tapered or have a generally uniform diameter from end 16 to end 18. In the tapered embodiment, end 16 in cross-section is smaller than end 18 in cross-section.

The joints of wall 26 and bottom 24 are smoothly rounded at both 28 and 30. Wall 26 is sloped with respect to the axis 19 to define an angle A from about 30° to about 55°. In proper hand held position, wall 26 is generally parallel to the surface. In a specific embodiment of the instrument of the invention, angle A is about 45°. Adjacent both end 16 and end 18 at positions B and C, shell 14 is conical in shape due to the taper of shell 14 between ends 16 and 18 and the lack of groove 22.

In a specific embodiment, shell 14 is at least 5 inches long, there are about four turns of groove 22 between ends 16 and 18, end 16 is from about 0.1875 inches to about 0.3325 inches in diameter and end 18 is from about 0.37 to about 0.63 inches in diameter. Wall 26 measures from about 0.0625 to about 0.1875 inches. Bottom 24 measures about 1 inch in width. In another specific embodiment in which the operational end is a surgical instrument, end 18 is outfitted with a swab 34 attached to end 18 by a conventional collar 36. In another embodiment in which the operational end is a laser pen, end 18 is merely rounded as shown in FIG. 1.

In operation, the ergonomic instrument of the invention is gripped like a pencil, pen or any other conventional writing instrument. The shell 14 can be made of plastic, wood, metal or any other material as desired. The groove 22 and the wall 24 allow the foreginger, thumb and middle finger to be positioned within the groove 22 adjacent end 16 with the rest of the shell 14 extending between the thumb and forefinger of the hand. The groove 22, however, allows pressure to be placed upon the operative end of the instrument during use by mere pushing of the forefinger and thumb against the wall 26 urging the instrument in the direction of the force applied. The improved instrument 10 of the invention allows more pressure to be applied in this fashion with a less tight grip of the instrument than with a conventional writing instrument having a straight shell. A loose grip will suffice with the improved instrument 10 of the invention thereby reducing fatigue and eliminating hand cramps and calluses that are related to prolonged use.

Also, the improved instrument 10 of the invention urges one to hold the instrument correctly in accordance with commonly agreed principles and allows children, older people and handicapped persons who have problems with gripping conventional instruments to adequately grip the instrument of the invention.

The improved instrument of the invention can be used by either right-handed or left-handed persons and can be gripped at any distance from its operative end that is comfortable to the user. Correct positioning of the instrument in the hand is adjusted automatically.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto;

What is claimed is:

1. An ergonomic, hand held instrument comprising a shell having a longitudinal axis having opposite ends and a hollow interior, an instrument positioned within said interior of said shell with its operational end extending from one of said shell ends, said shell having a groove therein extending from adjacent said one shell end axially of said shell, said groove having a bottom surface and an upstanding wall adapted for the fingers and the thumb of the hand holding the instrument to be positioned in said groove against said upstanding wall to apply a force in the axial direction during use, said groove spiraling around said shell, said bottom surface having a width greater than the size of the pad of said fingers, said groove having at least one partial turn adjacent to said one end and between said opposite shell ends, said bottom surface extending from said wall axially toward said other shell end, said fingers having no walls therebetween when placed in said groove, whereby one can pick up said instrument and easily grip said instrument correctly with a lighter grip than with conventional instruments and yet use without hand fatigue, cramps or calluses normally associated with use of the instrument for long periods of time.

2. The instrument of claim 1 wherein said shell is tapered from said one end to said other end, said one shell end being smaller in diameter than said other end.

3. The instrument of claim 1 wherein said wall and bottom are smoothly joined.

4. The instrument of claim 1 wherein the height of said wall is from about 0.0625 to about 0.1875 inches.

5. The instrument of claim 1 wherein said wall is sloped with respect to said axis.

6. The instrument of claim 5 wherein said wall and said axis define an angle of about 30° about 55°.

7. The instrument of claim 6 wherein said angle is about 45°.

8. The instrument of claim 1 wherein said shell is at least about 5 inches in axial length, said turns are about 4 in number, said one shell end is from about 0.1875 to about 0.3325 inches in diameter and said other shell end is from about 0.63 to about 0.37 inches in diameter.

9. The instrument of claim 2 wherein said shell adjacent said shell ends in conical.

10. The instrument of claim 9 wherein the joints of said wall and bottom are smoothly rounded, the height of said wall is from about 0.625 to about 0.1875 inches, said wall is sloped with respect to said axis, said wall and axis define an angle of about 30° to about 55°, said shell is at least about 5 inches long, said turns are about 4 in number, said one shell end is from about 0.1875 to about 0.3325 inches in diameter, and said other shell end is from about 0.67 to about 0.37 inches in diameter.

11. The instrument of claim 10 wherein said bottom is about 1 inch wide.

12. The instrument of claim 1 wherein said bottom is about 1 inch wide.

13. The instrument of claim 1 wherein said bottom surface is sloped with respect to said axis.

14. The instrument of claim 1 wherein said shell is tapered from said one shell end to said other shell end, said one shell end being smaller in diameter than said other shell end, said wall and bottom being smoothly joined.

15. The instrument of claim 1 wherein said shell is tapered from said one shell end to said other shell end, said one shell end being smaller in diameter than said other shell end, said wall and bottom being smoothly joined, said wall and bottom surface being sloped with respect to said axis.

16. The instrument of claim 1 wherein said shell is tapered from said one shell end to said other shell end, said one shell end being smaller in diameter than said other shell end, said wall and bottom being smoothly joined, said wall and bottom being sloped with respect to said axis, said shell ends being conical. v

* * * * *